US009728880B2

(12) United States Patent
Ejiri et al.

(10) Patent No.: US 9,728,880 B2
(45) Date of Patent: Aug. 8, 2017

(54) HOTLINE CONTACTING STRUCTURE

(71) Applicant: SMK Corporation, Tokyo (JP)

(72) Inventors: Koichiro Ejiri, Kanagawa (JP); Haruhiko Kondo, Kanagawa (JP); Rie Abe, Kanagawa (JP); Katsushi Oishi, Toyama (JP); Hidemasa Sakurada, Ibaraki (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/221,549

(22) Filed: Jul. 27, 2016

(65) Prior Publication Data

US 2017/0093067 A1 Mar. 30, 2017

(30) Foreign Application Priority Data

Sep. 30, 2015 (JP) ..... 2015-192482
Mar. 11, 2016 (JP) ..... 2016-048573

(51) Int. Cl.
*H01R 13/53* (2006.01)
*H01R 13/03* (2006.01)

(52) U.S. Cl.
CPC ..... *H01R 13/03* (2013.01)

(58) Field of Classification Search
CPC ..... H01R 13/03
USPC ..... 439/181, 187
See application file for complete search history.

(56) References Cited

U.S. PATENT DOCUMENTS 7,982,144 B2 * 7/2011 Kiryu ..... H01R 13/7038 200/51 R
2010/0029110 A1 2/2010 Kiryu et al.
2011/0028012 A1 * 2/2011 Chien ..... H01R 13/53 439/188

FOREIGN PATENT DOCUMENTS

JP S63-86281 A 4/1988
JP H4-2467 U 1/1992

* cited by examiner

*Primary Examiner* — Javaid Nasri

(57) ABSTRACT

The present invention is intended to provide a contact contacting structure for hot-line connection between contacts configured such that the occurrence of arc discharge between contacts is suppressed by a simple configuration. At least one of contact/separation contact surfaces in a pair opposed to each other at the contact/separation position between a first contact and a second contact is covered with an oxide film. At the time of contact or separation of the first contact and the second contact, the oxide film as an insulator intervenes between the paired contact/separation contact surfaces to decrease energy accumulated between the first contact and the second contact at the instant of contact or separation of the two contacts, thereby suppressing the occurrence of arc discharge.

9 Claims, 4 Drawing Sheets

(RELATED ART)

HOTLINE CONTACTING STRUCTURE

CROSS REFERENCE TO RELATED APPLICATION

The contents of the following Japanese patent applications are incorporated herein by reference, Japanese Patent Application No. 2015-192482 filed on Sep. 30, 2015, and Japanese Patent Application No. 2016-048573 filed on Mar. 11, 2016.

BACKGROUND

1. Technical Field

The present invention relates to a contact contacting structure between a pair of contacts respectively for hot-line connection with electric circuits, and more particularly, to a contact contacting structure in which high electric energy is generated between a pair of contacts that contacts with or separates from each other.

2. Related Art

An electric connector used for hot-line connection of electric power lines and the like for transmitting high voltage, high-current electric power causes an arc discharge between a pair of adjacent contacts when the other connector to which the electric connector is connected is inserted or removed, due to high electric energy that has been accumulated between the close contacts. Such arc discharge is also caused by induced electromotive force resulting from the removal of one connector connected to an inductive load from the other connector connected to the power line.

The arc discharge hastens deterioration of the electric connector such as erosion of the contacts. The problem has been addressed by largely two methods. According to the first method disclosed in JP-A-2010-56055 (Patent Literature 1), a permanent magnet or the like is disposed in the direction orthogonal to the direction of opposition between the pair of contacts to generate a magnetic field and deflect the direction of the arc by Lorentz force, thereby preventing damage to the contacts due to the arc discharge.

According to the second method, the electric energy accumulated between the pair of contacts is decreased to prevent the occurrence of arc discharge. The electric energy accumulated in the pair of contacts is in proportion to the voltage and current between the pair of contacts. Accordingly, JP-A-63-86281 (Patent Literature 2) and JP-UM-A-4-2467 (Patent Literature 3) describe techniques for lowering the voltage between the pair of contacts at the time of separation from each other to prevent the occurrence of arc discharge.

Specifically, in a contact contacting structure 100 described in Patent Literature 2 as illustrated in FIG. 6, a contact 101 and a resistor 102 with a higher electric resistivity ρ than that of the contact 101 are disposed continuously along a movement path in which a contact 103 of the counterpart connector moves, and when the other contact 103 is drawn out and separated from the movement path, the contact 103 is separated at a leading end 102*a* of the resistor 102 with the highest resistance value to keep the voltage between the two contacts resulting in no arch discharge, thereby preventing the occurrence of arc discharge.

In a contact contacting structure 110 described in Patent Literature 3, as illustrated in FIGS. 7A and 7B, the resistance value of a contact 112 is more increased as a counterpart contact 114 moves in a separating direction (the rightward direction in the drawings) along a movement path in which the counterpart contacts 114 moves. While the counterpart contact 114 is fully inserted as illustrated in FIG. 7A, when the counterpart contact 114 is drawn from the movement path as illustrated in FIG. 7B, a large potential drop is caused in the contact 112 such that a leading end 112*a* of the contact 112 to which the contact 114 is adjacent has the highest resistance, and the voltage between the leading end 112*a* and the contact 114 does not cause arc discharge.

According to the first method described in Patent Literature 1, a permanent magnet or the like is disposed in the direction orthogonal to the direction of the opposition between the pair of contacts to generate a magnetic field. Accordingly, the contact contacting structure is complicated and large-sized. In addition, the structure does not prevent the occurrence of arc discharge, and electromagnetic noise resulting from arc discharge would exert an adverse effect on an electronic circuit such as a load. Therefore, the first method does not constitute a substantive solution.

In the contact contacting structure 100 according to the second method, when being drawn out, the other contact 103 is separated from the contact 101 via the resistor 102 with high electric resistivity ρ, and the voltage at the leading end 102*a* of the resistor 102 drops due to the resistance value of the resistor 102. Since the resistance value of the resistor 102 is in proportion to the distance from a connection position ×0 relative to the contact 101, the resistance value of the resistor 102 is largest at a position ×1 of the leading end 102*a* of the resistor 102. However, even though the resistance value of the resistor 102 is largest at the leading end 102*a* of the resistor 102, the potential may not be sufficiently dropped by the resistor 102 depending on the voltage applied between the contacts 101 and 103 and the current flowing between the contacts 101 and 103, thereby leading to the occurrence of arc discharge.

In this case, the resistor 102 may be formed from a conductive material with a still higher electric resistivity ρ. However, if the resistor 102 with a higher resistance value is used, when the contact position of the contact 103 of the counterpart connector moves from the contact 101 to the resistor 102, the resistor 102 constitutes an insulator like the air to generate arc discharge by electric energy between the adjacent contacts 101 and 103. Therefore, the resistance value of the resistor 102 cannot be raised substantially until the contact position of the contact 103 comes at a predetermined distance from the connection position ×0, and the problem cannot be solved by the change of the conductive material.

Accordingly, the resistance value of the leading end 102*a* may be increased by extending the distance from the connection position ×0 to the leading end position ×1 of the resistor 102. However, the resistance value increases simply in proportion to the distance along the separating direction, and there is an upper limit to the resistance value of the resistor 102. The extension in the separating direction results in the larger size of the contact contacting structure.

In the contact contacting structure 110 described in Patent Literature 3, the resistance value is more increased as the contact 102 moves in the separating direction (the rightward direction in FIGS. 7A and 7B) along the movement path. The electric resistivity ρ of the conductive material for use in the contact 102 takes a value specific to each conductive material. Accordingly, in order to increase the resistance value per unit length along with the movement in the separating direction (the rightward direction in FIGS. 7A and 7B), it is necessary to prepare and arrange successively many kinds of conductive materials gradually larger in electric resistivity ρ in the separating direction. This method is not practical due to difficulty of manufacture.

SUMMARY

The present invention is devised in view of the foregoing known problems. An object of the present invention is to provide a contact contacting structure that suppresses reliably the occurrence of arc discharge by a simple configuration using a conductive material that has not been used as a contact material.

To attain the foregoing object, a contact contacting structure according to a first aspect is a contact contacting structure for hot-line connection between a first contact and a second contact while the second contact is in contact with a first slide contact surface of the first contact, the second contact contacting with or separating from the first contact in a sliding direction along the first slide contact surface of the first contact. An intermediate contact body is connected to the first contact at the contact/separation position relative to the second contact. The first slide contact surface of the first contact and a first contact/separation contact surface of the intermediate contact body are continuous along the sliding direction of the second contact. The first contact/separation contact surface is covered with an oxide film.

The first contact/separation contact surface of the intermediate contact body is covered with the oxide film with high contact resistance at the contact/separation position of the first contact relative to the second contact, and the oxide film with high contact resistance intervenes between the second contact and the first contact at the moment when they contact with each other or separate from each other. Accordingly, electric energy is unlikely to be accumulated to a degree that arc discharge is caused.

In the contact contacting structure according to a second aspect, the first contact/separation contact surface of the intermediate contact body formed from a valve metal is covered with a passivation film formed on the surface of the valve metal.

The passivation film is naturally formed on the surface of the intermediate contact body formed from the valve metal on contact with the air. Accordingly, the first contact/separation contact surface of the intermediate contact body connected to the first contact at the contact/separation position relative to the second contact is covered with the passivation film with high contact resistance as a kind of oxide film.

In the contact contacting structure according to a third aspect, the intermediate contact body is a metallic thin plate adhered to the first contact/separation contact surface side of the first contact.

The contact resistance between the intermediate contact body and the second contact via the passivation film does not depend on the size or length of the intermediate contact body. Accordingly, even the metallic thin plate does not affect the contact resistance to the second contact.

By forming the intermediate contact body as a metallic thin plate, it is easy to perform the process for adhering and connecting the intermediate contact body to the first contact at the contact/separation position. In addition, heat energy generated on the passivation film is thermally transferred to the connected first contact and then discharged.

In the contact contacting structure according to a fourth aspect, the first slide contact surface of the first contact made of a metal or an alloy is covered with plating.

By covering the first slide contact surface of the first contact with plating, the first contact can be excellent in corrosion resistance and be electrically connected to the second contact with low contact resistance.

In the contact contacting structure according to a fifth aspect, the intermediate contact body is made of stainless steel.

The stainless steel becomes oxidized by contact of contained chromium with the air to form the oxide film as passivation film on the first contact/separation contact surface.

In the contact contacting structure according to a sixth aspect, the second contact is formed from a plate spring piece in which a second slide contact surface in slide contact with the first slide contact surface of the first contact and a second contact/separation contact surface contacting with or separating from the first contact/separation contact surface of the intermediate contact body are continuous. The second contact/separation contact surface is covered with an oxide film.

At the time of contact or separation of the first contact and the second contact, the oxide film covering the first contact/separation contact surface of the intermediate contact body and the oxide film covering the second contact/separation contact surface of the second contact overlap and intervene between the first and second contacts.

In the contact contacting structure according to a seventh aspect, a metallic thin plate made of a valve metal is adhered to the contact/separation position of the second contact contacting with or separating from the first contact/separation contact surface. The second contact/separation contact surface is covered with a passivation film formed on the surface of the valve metal.

The passivation film is naturally formed on the metallic thin plate made of the valve metal on contact with the air, and the second contact/separation contact surface of the metallic thin plate connected to the contact/separation position relative to the first contact is covered with the passivation film with high contact resistance as a kind of oxide film.

A contact contacting structure according to an eighth aspect is a contact contacting structure for hot-line connection between a first contact and a second contact, and contact or separation of the second contact with or from the first contact at a first contact/separation contact surface continued to one end of a first slide contact surface of the first contact while the second contact is in contact with the first slide contact surface, the second contact moving forward or backward in a sliding direction along the first slide contact surface of the first contact. The second contact is formed from a plate spring piece in which a second slide contact surface in slide contact with the first slide contact surface of the first contact and a second contact/separation contact surface contacting with or separating from the first contact/separation contact surface of the first contact are continuous. At least one of the first contact/separation contact surface and the second contact/separation contact surface opposed to each other at the time of contact or separation of the first contact and the second contact is covered with an oxide film.

Since at least of the first contact/separation contact surface and the second contact/separation contact surface opposed to each other at the time of contact or separation of the first contact and the second contact is covered with the oxide film with high contact resistance, the oxide film with high contact resistance intervenes between the first contact and the second contact at the moment when they contact with each other or separate from each other. Accordingly, electric energy is unlikely to be accumulated to a degree that arc discharge is caused.

In the contact contacting structure according to a ninth aspect, a metallic thin plate made of a valve metal is adhered to the contact/separation position of the second contact contacting with or separating from the first contact/separation contact surface. The second contact/separation contact surface is covered with a passivation film formed on the surface of the valve metal.

Since the passivation film is naturally formed on the surface of the metallic thin plate made of the valve metal on contact with the air, the second contact/separation contact surface of the metallic thin plate connected to the contact/separation position of the second contact contacting with or separating from the first contact/separation contact surface is covered with the passivation film with high contact resistance as a kind of oxide film.

In the contact contacting structure according to a tenth aspect, the second slide contact surface of the second contact made of a metal or an alloy is covered with plating.

Since the second slide contact surface of the second contact is covered with plating, the second contact can be excellent in corrosion resistance and be electrically connected to the first contact with low contact resistance.

In the contact contacting structure according to an eleventh aspect, the valve metal is stainless steel.

The stainless steel becomes oxidized by contact of contained chromium with the air to form the oxide film as passivation film on the second contact/separation contact surface.

According to the first aspect of the invention, the oxide film with high contact resistance not depending on the electric resistivity of the intermediate contact body intervenes between the intermediate contact body and the second contact at the contact/separation position relative to the second contact. Accordingly, regardless of the size or length of the intermediate contact body, the voltage between the second contact and the intermediate contact body can be decreased to suppress the occurrence of arc discharge.

According to the second aspect of the invention, by simply connecting the intermediate contact body formed from the valve metal to the first contact at the contact/separation position relative to the second contact, it is possible to decrease the voltage between the second contact and the intermediate contact body, and allow the passivation film to intervene in the position of separation from the second contact, thereby to suppress the occurrence of arc discharge.

The intermediate contact body is covered with the passivation film to have corrosion resistance.

According to the third aspect of the invention, the intermediate contact body is formed of a metallic thin plate to facilitate connection at the contact/separation position of the first contact relative to the second contact.

Even though the intermediate contact body is formed of a metallic thin plate, there is no influence on the contact resistance of the second contact in contact with the passivation film. Accordingly, it is possible to discharge quickly the heat generated in the intermediate contact body to the first contact while suppressing the occurrence of arc discharge.

According to the fourth aspect of the invention, the slide contact surface of the first contact is covered with plating and is excellent in corrosion resistance. Accordingly, the first contact suffers less sliding deterioration even when the second contact is repeatedly in slide contact with the first contact.

In addition, the first contact contacts the second contact via the plating. Accordingly, hot-line connection with low contact resistance can be allowed.

According to the fifth aspect of the invention, the intermediate contact body is made of stainless steel, and therefore can be easily connected to the first contact by welding or soldering.

In addition, the intermediate contact body is made of stainless steel with small stress relaxation at high temperatures, and therefore has a predetermined strength causing no deformation even when heat is generated in the passivation film.

According to the sixth aspect of the invention, two layers of the oxide films with high contact resistance intervene between the intermediate contact body and the second contact, thereby to further decrease the voltage between the second contact and the intermediate contact body and suppress the occurrence of arc discharge reliably.

According to the seventh aspect of the invention, the metallic thin plate made of the valve metal can be easily connected to the contact/separation position of the second contact. By simply connecting to the contact/separation position, the passivation film can intervenes between the second contact and the intermediate contact body.

According to the eighth aspect of the invention, the oxide film with high contact resistance not depending on the electric resistivities of the first contact and the second contact intervenes between the first contact/separation contact surface and the second contact/separation contact surface that are opposed to each other at the time of contact or separation of the first contact and the second contact. This makes it possible to decrease the voltage between the first contact/separation contact surface and the second contact/separation contact surface and suppress the occurrence of arc discharge regardless of the sizes or lengths of the first contact and the second contact.

According to the ninth aspect of the invention, the metallic thin plate made of the valve metal can be easily connected to the contact/separation position of the second contact. By simply connecting to the contact/separation position, the passivation film can intervene between the first contact/separation contact surface and the second contact/separation contact surface.

According to the tenth aspect of the invention, the second slide contact surface of the second contact is covered with plating and is excellent in corrosion resistance. Accordingly, the second contact suffers less sliding deterioration even when the second contact is repeatedly in slide contact with the first contact.

In addition, the first contact and the second contact are in contact via the plating. Accordingly, hot-line connection with low contact resistance can be allowed.

According to the eleventh aspect of the invention, the metallic thin plate adhered to the contact/separation position of the second contact is made of stainless steel, and therefore can be easily connected to the second contact by welding or soldering.

In addition, the metallic thin plate is made of stainless steel with small stress relaxation at high temperatures, and therefore has a predetermined strength causing no deformation even when heat is generated in the passivation film.

DETAILED DESCRIPTION

Figure 1:
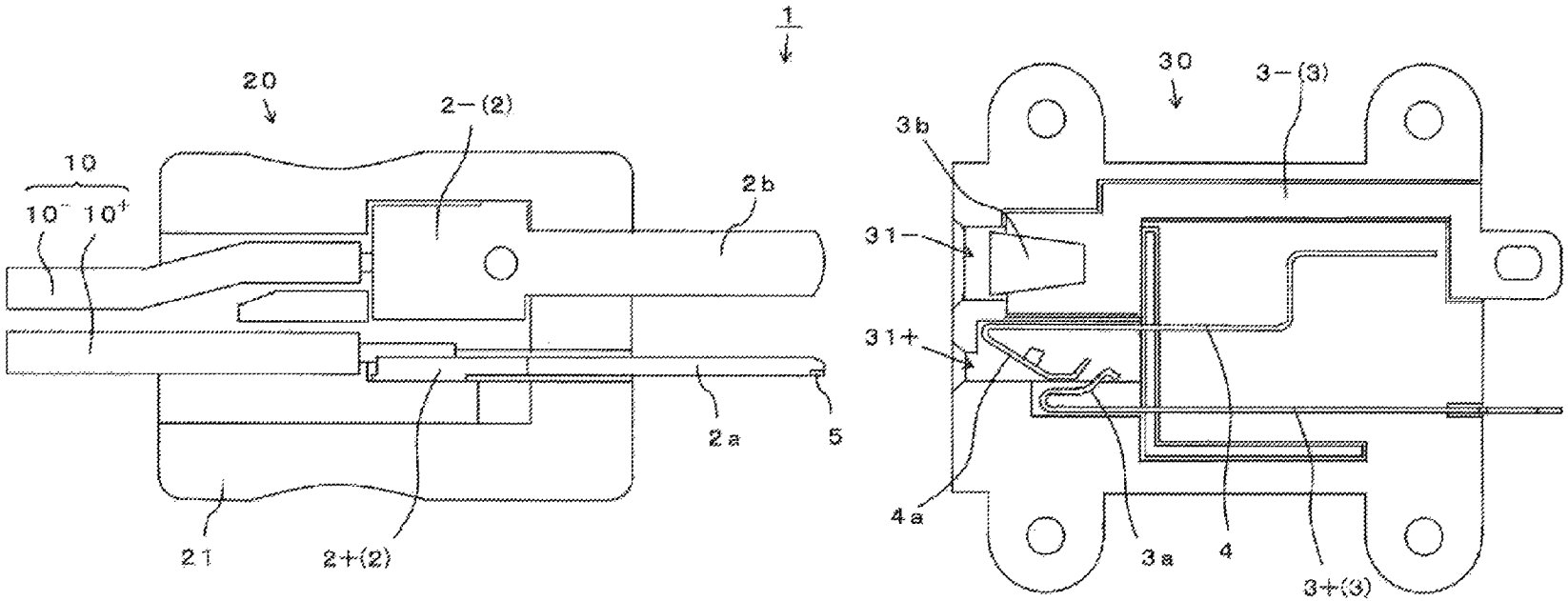
FIG. 1 is a perspective view of a contact contacting structure 1 according to an embodiment of the present invention in which a plug 20 has a male contact 2 and a socket 30 has a female contact 3, not illustrating upper covers of insulating cases 21 and 32.

A contact contacting structure 1 according to a first embodiment of the present invention will be explained below with reference to FIGS. 1 to 3. The contact contacting structure 1 is a structure in which a male contact 2 as a first contact and a female contact 3 as a second contact come into slide contact with each other. In the description herein, the contacting direction in which the male contact 2 is moved toward the female contact 3 will be defined as rightward direction, the separating direction in which the male contact 2 is moved away from the position of contact with the female contact 3 will be defined as leftward direction, and the vertical direction shown in FIG. 1 will be defined as vertical direction.

The male contact 2 is included in a plug 20 as a male connector connected to the terminal of a direct-current power supply line 10. The female contact 3 is included in a socket 30 as a female connector connected to a load operating with supply of power from the direct-current power supply line 10. By the insertion of the male contact 2 of the plug 20 into a plug insertion hole 31 of the socket 30 and the hot-line connection between the male contact 2 and the female contact 3 facing the plug insertion hole 31 under power, 48V, 2 A, 96 W power, for example, is supplied from the direct-current power supply line 10 to the load.

Figure 2:
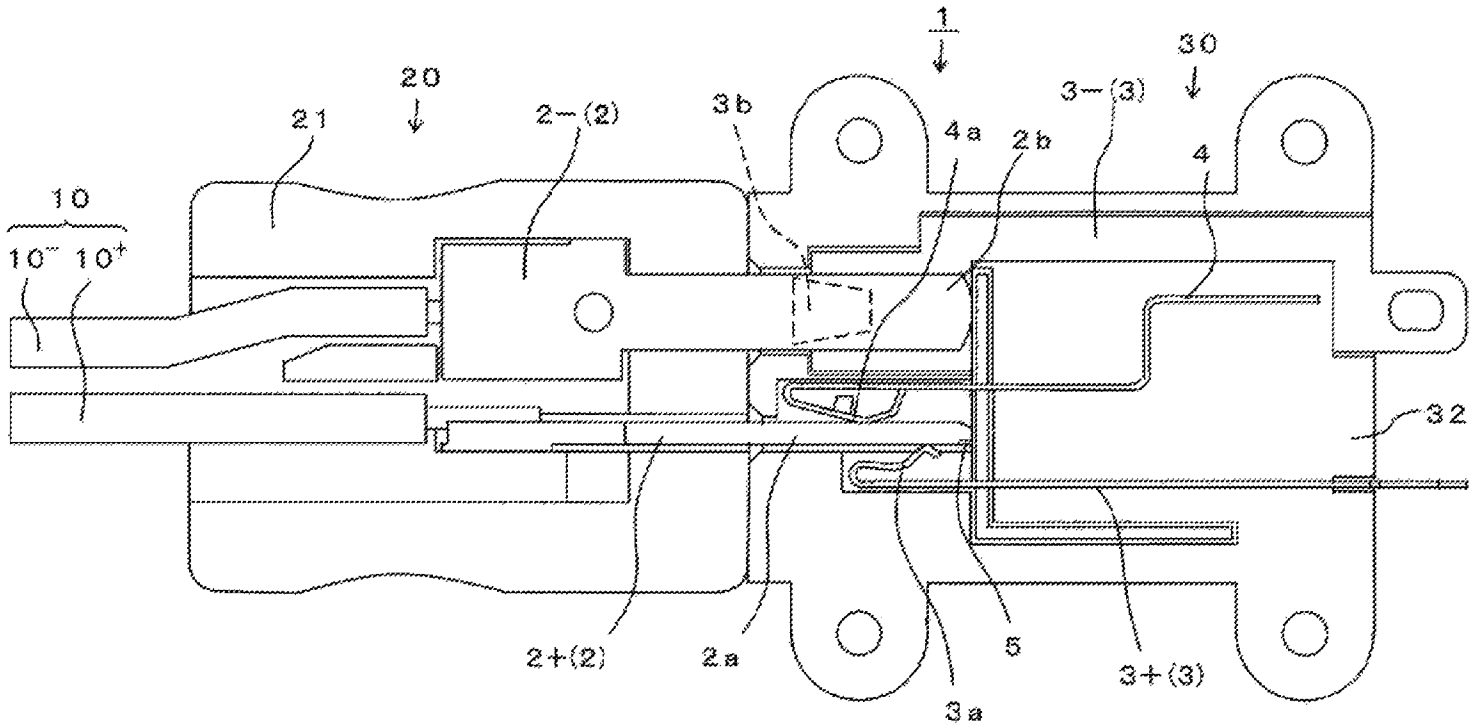
FIG. 2 is a perspective view illustrating the state in which the plug 20 is inserted into the socket 30 to bring the male contact 2 and the female contact 3 into contact, not illustrating the upper covers of the insulating cases 21 and 32.

As illustrated in FIG. 1, an insulating case 32 of the socket 30 contains three contacts: a pair of female contacts 3 that includes a high-voltage female contact 3+ formed by pressing and shaping a metallic plate of a copper alloy such as phosphor bronze or brass and a ground female contact 3− as a ground potential; and an auxiliary contact 4 formed from an elastic metallic plate. These contacts are insulated from one another and are horizontally attached. The high-voltage female contact 3+ has the left end portion folded upward in a U shape. The upper surface of a female contact portion 3*a* at the free end of the folded part is gold-plated and is faced toward the deep inside of a high-voltage plug insertion hole 31+ opened on the left side of the insulating case 32. The high-voltage female contact 3+ also has the right end protruding from the right surface of the insulating case 32 and connected to a high-voltage power supply line of the direct-current power supply lines connected to the load.

The auxiliary contact 4 has the left end portion folded downward in a U shape, and a folded portion 4*a* is faced inside the high-voltage plug insertion hole 31+ from the upper surface opposite to the lower surface toward which the female contact portion 3*a* is faced. As described later, a high-voltage male contact 2+ inserted into the high-voltage plug insertion hole 31+ is biased from above to connect electrically the high-voltage male contact 2+ as the first contact and the high-voltage female contact 3+ as the second contact in a reliable manner under increased contact pressure.

The ground female contact 3− is attached to the insulating case 32 in the vertical direction as a width direction of a belt-like portion. The ground female contact 3− has the left end portion folded in a U shape toward the front side of the page space of FIG. 1. A female ground contact portion 3*b* at the folded free end is faced toward the deep inside of a ground plug insertion hole 31− opened on the left side of the insulating case 32. The ground female contact 3− has the right end protruded from the right surface of the insulating case 32 and connected to a ground power supply line of the direct-current power supply lines connected to the load.

An insulating case 21 of the plug 20 contains a pair of male contacts 2 that includes a high-voltage male contact 2+ formed in a flat-blade shape by pressing a metallic plate of a copper alloy such as phosphor bronze or brass and a ground male contact 2− as a ground potential. These contacts are insulated from each other and attached in the horizontal direction.

The ground male contact 2− is attached to the insulating case 21 in the vertical direction as a width direction of the flat blade such that the ground male contact 2− is in parallel to the ground female contact 3− of the socket 30 while the socket 30 and the plug 20 are connected. The ground male contact 2− has the left end portion connected to a ground power supply line 10− of the direct-current power supply lines 10 within the insulating case 21. The right end portion protruding from the right surface of the insulating case 32 is inserted into a ground plug insertion hole 31− of the socket 30 to constitute a male ground contact portion 2*b* in contact with the female ground contact portion 3*b*.

The high-voltage male contact 2+ is attached to the insulating case 21 in the vertical direction as a thickness direction of the flat blade such that the high-voltage male contact 2+ is sandwiched between the high-voltage female contact 3+ and the auxiliary contact 4 of the socket 30 in the thickness direction while the socket 30 and the plug 20 are connected. The high-voltage male contact 2+ has the left end portion connected to a high-voltage power supply line 10+ of the direct-current power supply lines 10 within the insulating case 21. The high-voltage male contact 2+ has a male contact portion 2*a* that protrudes from the right surface of the insulating case 32 where the male contact portion 2*a* is insertable into the high-voltage plug insertion hole 31+ of the socket 30. When inserted into the high-voltage plug insertion hole 31+, the male contact portion 2*a* is biased by the folded portion 4*a* of the auxiliary contact 4 toward the lower high-voltage female contact 3+, and the female contact portion 3*a* of the high-voltage female contact 3+ comes into slide contact under predetermined contact pressure.

Figure 3:
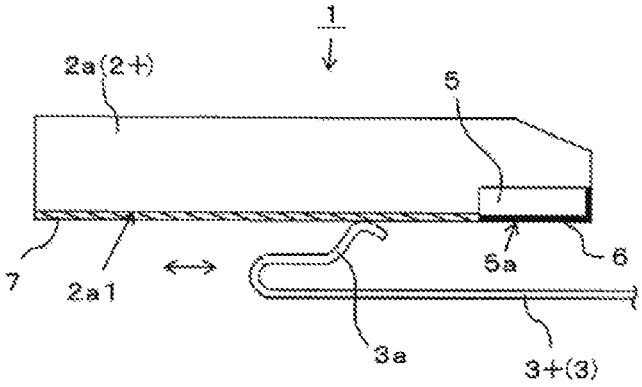
FIG. 3 is a side view of the contact contacting structure 1 in which the female contact 3 is in slide contact with a slide contact surface 2*a*1 of the male contact 2.

As illustrated in FIG. 3, a metallic thin plate 5 made of stainless steel as a valve metal is soldered and adhered to the lower surface of the leading end portion at the contact/ separation position of the high-voltage male contact 2+ contacting with or separating from the high-voltage female contact 3+ (the surface opposing to the high-voltage female contact 3+). Therefore, the female contact portion 3*a* of the high-voltage female contact 3+ is in continuous slide contact with a slide contact surface 2*a*1 as the lower surface of the male contact portion 2*a* to a contact/separation contact surface 5*a* as the lower surface of the metallic thin plate 5 along with insertion or removal of the high-voltage male contact 2+.

On contact with the air, chromium contained in stainless steel becomes oxidized to form a passivation film of chromium trioxide ($Cr_2O_3$) as a kind of oxide film on the surface of the stainless. Accordingly, a passivation film 6 with a thickness of several nm is formed on the contact/separation contact surface 5*a* of the metallic thin plate 5 formed from stainless steel. Chromium trioxide ($Cr_2O_3$) is an insulating substance that constitutes an electric resistance of several hundreds of MΩ in the thickness direction per contact area of 1 $mm^2$. As a result, the passivation film 6 with a thickness of several nm is formed between the metallic thin plate 5 connected at the contact/separation position of the high-voltage male contact 2+ and the high-voltage female contact 3+ to generate a contact resistance of several to several tens of Ω between the two.

In general, if the contacts of connectors for hot-line connection between power lines through which a large current of several A flows are made of a valve metal such as stainless steel, voltage drop or power loss occurs due to the contact resistance of the passivation film formed on the contact surfaces as described above, and the contact surfaces generate heat due to the contact resistance. Accordingly, a valve metal is not usually used as a material for the contacts.

In the embodiment, the metallic thin plate 5 with the passivation film 6 is connected at the contact/separation position of the high-voltage male contact 2+ where the high-voltage female contact 3+ contacts or separates to generate intentionally a contact resistance of several to several tens of Ω by the passivation film 6 between the high-voltage female contact 3+ and the high-voltage male contact 2+ at the instant of contact or separation. This suppresses effectively the occurrence of arc discharge at the instant of contact or separation of the high-voltage female contact 3+ and the high-voltage male contact 2+ as described later.

The ground female contact 3− and the ground male contact 2− are both at ground potentials and no electric energy causing arc discharge is accumulated therebetween. Accordingly, such an intermediate contact body as the metallic thin plate 5 is not provided at the male ground contact portion 2*b*. In the following description, therefore, the high-voltage male contact 2+ and the high-voltage female contact 3+ will be referred to as simply male contact 2 and female contact 3, respectively.

The slide contact surface 2*a*1 as the lower surface of the male contact portion 2*a* without the metallic thin plate 5 of the male contact 2 is covered with gold plating 7 as illustrated in FIG. 3. Accordingly, the male contact 2 is electrically connected to the female contact 3 with low contact resistance. In addition, the male contact portion 2*a* of the male contact 2 and the metallic thin plate 5 are covered with the gold plating 7 and the passivation film 6 to exhibit high corrosion resistance.

To insert the thus configured plug 20 into the socket 30, the paired male contact portion 2*a* and male ground contact portion 2*b* of the plug 20 are inserted from the left side into the high-voltage plug insertion hole 31+ and the ground plug insertion hole 31− of the socket 30, respectively. Further, when they are inserted rightward, the female ground contact portion 3*b* of the ground female contact 3− first comes into elastic contact with the male ground contact portion 2*b*, and the ground male contact 2− and the ground female contact 3− are electrically connected together.

As the plug 20 moves rightward in the inserting direction, the folded portion 4*a* of the auxiliary contact 4 slides while being in elastic contact with the upper surface of the male contact portion 2*a*, the female contact portion 3*a* of the female contact 3 contacts the contact/separation contact surface 5*a* of the metallic thin plate 5, and then comes into continuous slide contact with the contact/separation contact surface 5*a* to the slide contact surface 2*a*1. Accordingly, the process for hot-connection between the male contact 2 and the female contact 3 and between the ground male contact 2− and the ground female contact 3− is completed at the position illustrated in FIG. 2 where the insulating case 21 of the plug 20 is abutment with the insulating case 32 of the socket 30.

To extract the plug 20 from the socket 30, the plug 20 is moved leftward from the foregoing connection position. Along with the leftward movement, the male contact 2 and the female contact 3 are disconnected, and the ground male contact 2− and the ground female contact 3− are disconnected in the reverse of the foregoing contact order. Specifically, the female contact portion 3*a* of the female contact 3 at the connected position comes into continuous slide contact with the slide contact surface 2*a*1 of the male contact portion 2*a* to the contact/separation contact surface 5*a* of the metallic thin plate 5, and then separates from the contact/separation contact surface 5*a*, thereby disconnecting the male contact 2 and the female contact 3. After that, the folded portion 4*a* of the auxiliary contact 4 separates from the male contact portion 2*a*, and the female ground contact portion 3*b* separates from the male ground contact portion 2*b*.

In the processes of connection and extraction of the plug 20 described above, the female contact portion 3*a* of the female contact 3 and the contact/separation contact surface 5*a* of the metallic thin plate 5 contact with and separate from each other at some instants with a specific potential difference V. Assuming that the potential difference between the female contact 3 and the contact/separation contact surface 5*a* of the metallic thin plate 5 opposed to each other at the instant of separation is designated as V and a current flowing into the two as I, when electric energy E accumulated between the two ($E=\int V \cdot I dt$) exceeds a specific boundary value, arc discharge occurs between the two. As for the connection between the plug 20 and the socket 30 according to the embodiment, arc discharge occurs when the potential difference V exceeds 25V and the current I exceeds 2 A. According to the embodiment, however, the passivation film 6 as an insulating film is formed on the contact/separation contact surface 5*a* of the metallic thin plate 5, the potential on the contact/separation contact surface 5*a* side of the metallic thin plate 5 decreases due to a contact resistance of several to several tens of Ω generated by the passivation film 6. As a result, the potential difference V between the female contact 3 and the contact/separation contact surface 5*a* of the metallic thin plate 5 at the instant of separation decreases to suppress the occurrence of arc discharge.

While the female contact portion 3*a* of the female contact 3 is in contact with the contact/separation contact surface 5*a* of the metallic thin plate 5, the contact portion generates heat due to surface resistance by the passivation film 6. However, the section of the contact between the plug 20 and the socket 30 is very small during the insertion or extraction of the plug 20 into or from the socket 30. Even when the insertion or extraction of the plug 20 is stopped at the position of connection between the two, the metallic thin plate 5 is thin and adhered to the male contact portion 2*a* and the generated heat is discharged to the female contact 3 by thermal transfer.

According to the embodiment, the metallic thin plate 5 is made of stainless steel with small stress relaxation at high temperatures, and the metallic thin plate 5 has a predetermined strength and is unlikely to be deformed even with heat generation by the passivation film 6.

The contact resistance of several to several tens of Ω generated by the passivation film 6 formed on the surface of the metallic thin plate 5 is irrelevant to the electric resistivity ρ of the metallic material for forming the metallic thin plate 5. Accordingly, it is possible to interpose a sufficient resistance for suppression of arc discharge between the female contact 3 and the contact/separation contact surface 5*a* of the metallic thin plate 5 regardless of the shape of the metallic thin plate 5 even when the metallic thin plate 5 is small in length.

In addition, the metallic thin plate 5 can be formed from a metallic material with electric resistivity ρ similar to that of the male contact 2. Accordingly, there is no potential difference V causing arc discharge between the female contact 3 and the male contact portion 2*a* via the metallic thin plate 5. Therefore, no arc discharge occurs when the female contact portion 3*a* moves from the male contact portion 2*a* to the metallic thin plate 5.

Figure 4:
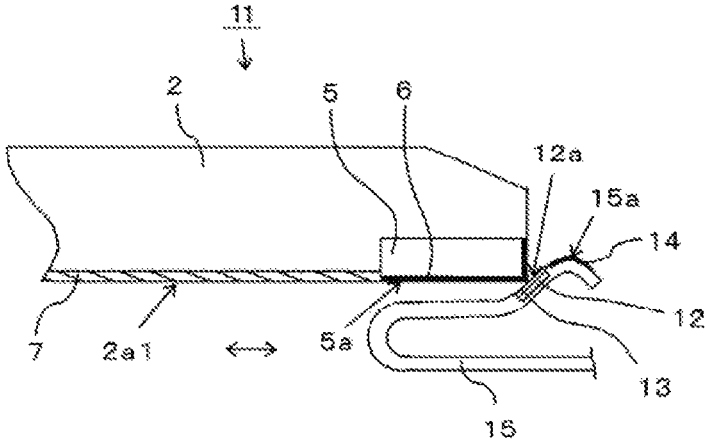
FIG. 4 is a side view of a contact contacting structure 11 according to a second embodiment in which a second contact/separation contact surface 12*a* of a female contact 15 contacts with or separates from a first contact/separation contact surface 5*a* of a male contact 2.
Figure 5:
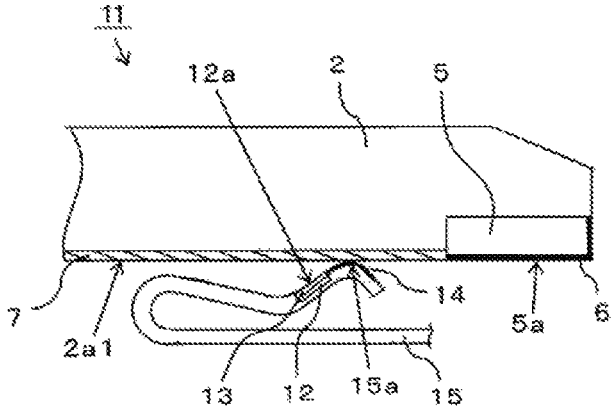
FIG. 5 is a side view of the contact contacting structure 11 according to the second embodiment in which a second slide contact surface 15*a* of the female contact 15 is in slide contact with a first slide contact surface 2*a*1 of the male contact 2.
Figure 6:
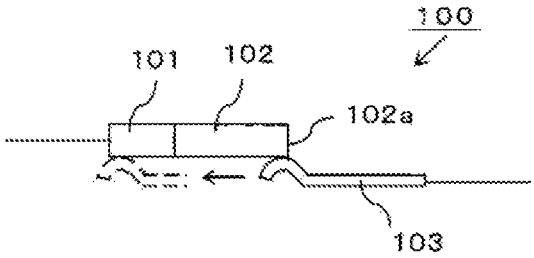
FIG. 6 is a side view of a typical contact contacting structure 100.
Figure 7A:
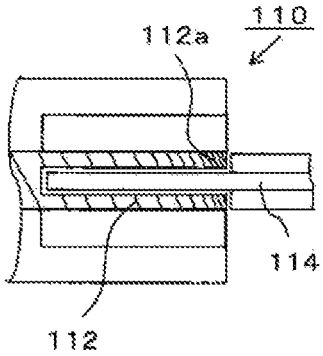
(RELATED ART) FIG. 7A
FIG. 7A is a vertical cross-sectional view of the typical contact contacting structure 110 in which a counterpart contact 114 is fully inserted.
Figure 7B:
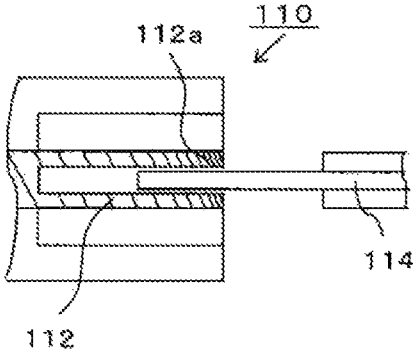
(RELATED ART) FIG. 7B
FIG. 7B is a vertical cross-sectional view of the typical contact contacting structure 110 in which the counterpart contact 114 is removed from a movement path.

FIGS. 4 and 5 illustrate a contact contacting structure 11 according to a second embodiment of the present invention. The male contact 2 according to the first embodiment is connected to a metallic thin plate 12 with covering of an oxide film on the surface at a contact/separation position relative to the male contact 2 of a female contact 15. Besides the male contact 2, other components illustrated in these figures are the same as those according to the first embodiment, and they are given the same numbers as those in the first embodiment and descriptions thereof are omitted.

The female contact 15 is formed from an elongated belt-like plate spring piece as the female contact 3, and has the left end portion folded upward in the U shape. The diagonally upper surface of a folded portion constitutes a contact/separation position where the female contact 15 contacts with or separates from the male contact 2 as illustrated in FIG. 4. In the embodiment, the metallic thin plate 12 formed from a valve metal is also adhered to the contact/separation position of the female contact 15 by soldering or the like such that a second contact/separation contact surface 12*a* of the metallic thin plate 12 opposed to the first contact/separation contact surface 5*a* of the male contact 2 at the contact/separation position relative to the male contact 2 is covered with a passivation film 13.

Accordingly, when the male contact 2 and the female contact 15 contact with or separate from each other, the passivation films 6 and 13 overlap and intervene between the first contact/separation contact surface 5*a* and the second contact/separation contact surface 12*a* opposed to each other. Therefore, there is no potential difference V causing arc discharge between the male contact portion 2*a* of the male contact 2 and the female contact 3 at the time of contact or separation, thereby to suppress the occurrence of arc discharge.

Since the female contact 15 is formed from a plate spring piece, when the male contact 2 further moves rightward from the contact/separation position illustrated in FIG. 4, the female contact 15 elastically deforms to move the contact position relative to the male contact 2 from the second contact/separation contact surface 12*a* toward the upper right free end, and the second slide contact surface 15*a* of the upper end comes into slide contact with the first slide contact surface 2*a*1 of the male contact 2 as illustrated in FIG. 5.

Since the second slide contact surface 15*a* is not covered with an oxide film, the hot-line connection between the male contact 2 and the female contact 15 is made with low contact resistance and power is supplied from the direct-current power supply line 10 to the load with low connection loss while the second slide contact surface 15*a* is in slide contact with the first slide contact surface 2*a*1 of the male contact 2.

In the second embodiment, when the potential difference V between the first contact/separation contact surface 5*a* and the second contact/separation contact surface 12*a* opposed to each other can be decreased to suppress the occurrence of arc discharge only by the passivation film 13 covering the second contact/separation contact surface 12*a*, there is no need to cover the first contact/separation contact surface 5*a* of the metallic thin plate 5 with the passivation film 6 at the contact/separation position relative to the male contact 2 but the entire lower surface of the male contact 2 may constitute the slide contact surface 2*a*1.

In addition, the second slide contact surface 15*a* may be covered with gold plating 14 to prevent corrosion of the second slide contact surface 15*a* and bring the second slide contact surface 15*a* into slide contact with the first slide contact surface 2*a*1 with still lower contact resistance.

In the foregoing embodiments, the metallic thin plates 5 and 12 connected at the contact/separation position are made of stainless steel to cover the first contact/separation contact surface 5*a* or the second contact/separation contact surface 12*a* with a passivation film. Alternatively, the metallic thin plates 5 and 12 may be made of any one or alloy of Ni, Co, Cr, Nb, Ta, Al, and Mo as valve metals capable of forming a passivation film on the surface.

In addition, in the case of covering the first contact/separation contact surface 5*a* or the second contact/separation contact surface 12*a* with an oxide film, the surface may not be necessarily covered with a passivation film. Instead of the metallic thin plate 5 or 12, a metallic thin plate of alumite with an oxide aluminum film on the surface may be connected at the contact/separation position. Alumite is produced by anodizing aluminum to form an oxide aluminum film on the surface. The oxide aluminum film is thin but acts as an insulator with a surface resistance of several to several tens of Ω.

In the foregoing embodiments, the metallic thin plate 5 as the intermediate contact body is connected to the lower side of the leading end of the male contact 2 contacting with or separating from the female contact 3. Alternatively, the metallic thin plate 5 may be connected to the right end side of the male contact 2 because the right end of the male contact 2 is also at the contact/separation position along the sliding direction.

The thickness of the metallic thin plates 5 and 12 can be arbitrarily set as far as they do not compromise the sliding of the counterpart contacts 3 and 2 in the sliding direction. For example, the metallic thin plates 5 and 12 may be formed of metallic foil.

The plating applied to the slide contact surface 2*a*1 and 15*a* is not limited to gold plating but may be nickel plating, tin plating, or the like.

The metallic thin plates 5 and 12 are soldered. Alternatively, the metallic thin plates 5 and 12 may be electrically and mechanically connected by any other connection method such as welding.

The foregoing embodiments relate to the contact structures for the male contact 2 of the plug 20 and the female contact 3 of the socket 30 for hot-line connection of direct-current power. Alternatively, the pair of contacts for hot-line connection is also applicable to contact structures for contacts for use in relays or switches as well as electric connectors composed of plugs and sockets.

The embodiments of the present invention are suitable to a contact contacting structure for hot-line connection between the contacts with fear of arc discharge.

What is claimed is:

1. A contact contacting structure for hot-line connection between a first contact and a second contact while the second contact is in contact with a first slide contact surface of the first contact, the second contact contacting with or separating from the first contact in a sliding direction along the first slide contact surface of the first contact, wherein an intermediate contact body is connected to the first contact at a contact/separation position relative to the second contact, the first slide contact surface of the first contact and a first contact/separation contact surface of the intermediate contact body are continuous along the sliding direction of the second contact, the first contact/separation contact surface is covered with an oxide film, and the intermediate contact body is a metallic component adhered to the first contact/separation contact surface side of the first contact.

2. The contact contacting structure according to claim 1, wherein the first contact/separation contact surface of the intermediate contact body formed from a valve metal is covered with a passivation film formed on the surface of the valve metal.

3. The contact contacting structure according to claim 1, wherein the first slide contact surface of the first contact made of a metal or an alloy is covered with plating.

4. The contact contacting structure according to claim 1, wherein the intermediate contact body is made of stainless steel.

5. The contact contacting structure according to claim 1, wherein the second contact is formed from a plate spring piece in which a second slide contact surface in slide contact with the first slide contact surface of the first contact and a second contact/separation contact surface contacting with or separating from the first contact/separation contact surface of the intermediate contact body are continuous, and the second contact/separation contact surface is covered with an oxide film.

6. The contact contacting structure according to claim 5, wherein a metallic thin plate made of a valve metal is adhered to the contact/separation position of the second contact contacting with or separating from the first contact/separation contact surface, and the second contact/separation contact surface is covered with a passivation film formed on the surface of the valve metal.

7. A contact contacting structure for hot-line connection between a first contact and a second contact, and contact or separation of the second contact with or from the first contact at a first contact/separation contact surface continued to one end of a first slide contact surface of the first contact while the second contact with the first slide contact surface, the second contact moving forward or backward in a sliding direction along the first slide contact surface of the first contact, wherein the second contact is formed from a plate spring piece in which a second slide contact surface in slide contact with the first slide contact surface of the first contact and a second contact/separation contact surface contacting with or separating from the first contact/separation contact surface of the first contact are continuous, at least one of the first contact/separation contact surface and the second contact/separation contact surface opposed to each other at the time of contact or separation of the first contact and the second contact is covered with an oxide film, and a metallic component made of a valve metal is adhered to the contact/separation position of the second contact contacting with or separating from the first contact/separation contact surface, and the second contact/separation contact surface is covered with a passivation film formed on the surface of the valve metal.

8. The contact contacting structure according to claim 7, wherein the second slide contact surface of the second contact made of a metal or an alloy is covered with plating.

9. The contact contacting structure according to claim 7, wherein the valve metal is stainless steel.

* * * * *